US009220307B2

(12) United States Patent
Clayton

(10) Patent No.: US 9,220,307 B2
(45) Date of Patent: Dec. 29, 2015

(54) DUAL-USE HANDCOVERING FOR PROTECTING THE HAND OF WEARER FROM THE ATMOSPHERIC CONDITIONS IN THE SURROUNDING ENVIRONMENT

(71) Applicant: Susan R. Clayton, Baltimore, MD (US)

(72) Inventor: Susan R. Clayton, Baltimore, MD (US)

( * ) Notice: Subject to any disclaimer, the term of this patent is extended or adjusted under 35 U.S.C. 154(b) by 0 days.

(21) Appl. No.: 14/209,352

(22) Filed: Mar. 13, 2014

(65) Prior Publication Data

US 2015/0257466 A1 Sep. 17, 2015

(51) Int. Cl.
*A41D 19/01* (2006.01)
*A41D 19/00* (2006.01)

(52) U.S. Cl.
CPC ..... *A41D 19/01* (2013.01); *A41D 19/0013* (2013.01)

(58) Field of Classification Search
CPC .... A41D 19/0013; A41D 19/17; A41D 19/01
USPC ..... 2/16–21, 158–160, 161.1–161.8, 2/162–164
See application file for complete search history.

(56) References Cited

U.S. PATENT DOCUMENTS

| | | | | | |
|---|---|---|---|---|---|
| 1,225,588 | A | * | 5/1917 | Curtiss | 2/20 |
| 1,310,120 | A | * | 7/1919 | Kreamer | 2/158 |
| 2,315,889 | A | * | 4/1943 | Wells | 2/158 |
| 3,403,408 | A | * | 10/1968 | Blanche | 2/158 |
| 4,408,358 | A | | 10/1983 | Swan | |
| 4,723,324 | A | | 2/1988 | Lassiter | |
| 4,850,052 | A | | 7/1989 | Matthews | |
| 4,881,276 | A | | 11/1989 | Swan | |
| 5,172,427 | A | | 12/1992 | Van Bergen et al. | |
| 5,509,143 | A | * | 4/1996 | Yates et al. | 2/160 |
| D380,285 | S | | 7/1997 | Babcock | |
| 5,774,894 | A | * | 7/1998 | Yates et al. | 2/158 |
| 6,338,163 | B1 | * | 1/2002 | Markson | 2/163 |
| 6,691,321 | B1 | | 2/2004 | Matut | |
| D489,149 | S | | 4/2004 | Horner | |
| D556,385 | S | | 11/2007 | Hostetler et al. | |
| 7,383,591 | B1 | | 6/2008 | Getzwiller et al. | |
| 7,934,270 | B2 | | 5/2011 | Kishino | |

OTHER PUBLICATIONS

Nike Tech Runner's Index Mitt (now discontinued) http://www.runoutlet.com/product_p/43634.htm#color=33519.
Pop Top Mitten http://www.heatfactory.com/english/category.php?cat=12 http://www.ebay.com/itm/Pop-Top-Mitten-Glove-Includes-Free-Hand-Warmer-/290528025321?pt=US_CSA_MWA_Gloves_Mittens&var=&hash=item43a4d1dae9.

* cited by examiner

*Primary Examiner* — Khaled Annis
(74) *Attorney, Agent, or Firm* — Pamela K. Riewerts, Esq.; Larry J. Guffey, Esq.; Oliver & Grimsley, LLC

(57) ABSTRACT

A dual-use hand covering adapted for a wearer who is running for exercise, the covering comprising a clingable sleeve of flexible material having a proximal and distal end, an opening at each end so that the hand of a wearer can enter the proximal opening and is adapted to allow the fingertips to extend through the distal opening, the sleeve adapted to enclose together the four fingers and thumb of a wearer such that the sleeve stays in close proximity to the hand, and a clingable cap, wherein a portion of the clingable cap is attached to the clingable sleeve and the clingable cap assumes a first or a second position, wherein the clingable cap encloses the distal clingable sleeve end and the fingertips of the wearer and also folds backwards to lie proximate to the clingable sleeve and thereby expose only the fingertips to the atmospheric conditions.

8 Claims, 5 Drawing Sheets

DUAL-USE HANDCOVERING FOR PROTECTING THE HAND OF WEARER FROM THE ATMOSPHERIC CONDITIONS IN THE SURROUNDING ENVIRONMENT

BACKGROUND OF THE INVENTION

1. Field of the Invention

The present invention relates generally to the general field of hand coverings, gloves, and mittens. More particularly, the invention disclosed herein relates a type of fingerless mitt for one who is running outdoors for exercise.

2. Description of the Related Art

The present invention is particularly applicable to the running fitness industry, and to one who typically runs for exercise in non-ideal atmospheric environmental conditions, and will be described with particular reference thereto.

The continuing concern among those in the outdoor exercise industry and among routine outdoor runners is being able to comfortably run outdoors even when the environment exhibits inclement external elements on a runner and in particular, to the runner's unprotected hands. Over an extended period of time, the runner's hands exposed to inclement atmospheric conditions will cause a runner to experience discomfort and will also negatively impact a runner's overall performance. In some cases, these inclement conditions may prevent a runner from engaging in outdoor exercise altogether. As a result, non-ideal atmospheric conditions greatly impact whether the runner participates in outdoor exercise, the length of time involved in the activity, and how the runner engages the use of his or her hands on days when poor atmospheric conditions exist. As a result, these inclement weather conditions ultimately impact a runner's exercise, strength, endurance, overall health, and other physical capabilities.

The prior art teaches various types of hand coverings, including exercise and sporting gloves and mittens to protect the hand from cold elements. These gloves and mittens provide a warm, protected environment for the hands of outdoor wearers in its intended purpose.

Various types of hand coverings exist, thereby permitting a runner to use gloves and mittens in order to protect his or her hands from the cold weather elements when running for exercise outdoors. Most, if not all, of these hand coverings involve some sort of additional layering or enclosure for the hand. When a runner utilizes one of these hand coverings, the hand is inserted into the covering. Despite the covering, the wearer may continue to feel residual cold weather impact or other inclement atmospheric conditions on the wearer's hand. Ultimately, when the wearer experiences these non-ideal conditions for an extended period of time, the wearer's exposed extremities, such as the wearer's hands and fingers, tend to decrease in body temperature, lose feeling, and experience numbness, tingling, discomfort, pain, and a reduced level of dexterity. The exposure to the inclement atmospheric conditions may be such that a wearer may choose not to exercise outdoors, or may decrease the amount of time a wearer stays outdoors for exercise. Even if the wearer does choose to exercise outdoors in spite of the conditions, the wearer's overall fitness performance is greatly impacted during exercise due to the physical effect on the wearer's hands.

The goal of many hand coverings is to promote protection of the hand from the outdoor elements, provide a comfortable environment for the hand inside of the covering and promote maximum warmth characteristics, while also providing the option of easily using one's hand to perform activities requiring dexterity without substantially interrupting the activity.

Moreover, a further goal is to facilitate the function of the hand, muscles, and fingers to be utilized by one who is running for exercise outdoors.

Conventional gloves or mittens suffer from a number of drawbacks. One such drawback is that conventional gloves typically have a singular, covered tubular shaft for each finger, including the thumb, thereby increasing the maximum surface area of the material on the hand, fingers, and thumb, and allowing the cold weather to envelop a substantial portion of the hand and finger extremities. In addition, the glove finger shafts separate each finger individually, thereby failing to utilize the ability of the wearer's body to generate and use its own body heat to maintain a warm and comfortable temperature for the hand and to heat its thumb and finger extremities adequately. As a result, over a period of time, the wearer will begin to experience the external elements and cold temperatures on his or her hands and fingers, therefore resulting in discomfort, numbing, and pain for the wearer.

In addition, another common drawback associated with traditional hand coverings, such as conventional mittens, is that they typically do not fit the hand well. Mittens completely encompass a wearer's four fingers together in one enclosure and also contain one separate tubular shaft for the wearer's thumb. The enclosure of the four fingers is fashioned with material in a balloon type configuration. This type of balloon configuration allows a space to be present between the material of the mitten and the wearer's hand; the mitten thereby is not tactile and clingable to the wearer's hand, and also does not encapsulate all four fingers and the thumb of the wearer in one enclosure, and so the mitten does not sufficiently promote and use the wearer's body heat to maintain a warm environment for the wearer's hand. Because the mitten configuration separates the thumb from enclosure with the fingers, the thumb usually experiences conditions similar to those of other hand coverings featuring individual finger shafts, such as with the common drawbacks associated with gloves as described above. Therefore, due to the balloon type configuration of the material and the separation of the fingers and thumb, a wearer often continues to be negatively impacted by inclement, outdoor elements during exercise.

Moreover, a mitten styled hand covering reduces the wearer's level of dexterity. Because mittens encapsulate a wearer's four fingers together in one contained enclosure, a wearer is unable to perform activities that require a certain level of dexterity without interrupting the wearer's participation in the activity by having to remove the mittens from the wearer's hands.

More recently, fingerless gloves have been introduced to the exercise industry. These types of fingertip-less gloves allow the wearer to maintain a certain level of dexterity but do not address the exposure of the wearer's fingertips to the atmospheric conditions during outdoor exercise. Likewise, fingerless gloves constructed with a top cap to cover a wearer's exposed fingertips have been introduced to the industry. These types of capped fingerless gloves present drawbacks similar to regular gloves and mittens, as the fingers are maintained in individual shafts with fingertips exposed within a balloon styled configuration as described above. Therefore, either immediately or overtime, the wearer will feel the effects of the inclement outdoor elements on a portion of his or her fingers and fingertips.

More recently, gloves and mittens have been introduced in the industry that feature a configuration of a combined glove and mitten in one embodiment. These types of combination hand coverings provide an enclosure of the last three fingers of the hand together in one compartment, similar to a mitten, while the index finger and thumb are each individually configured to each have their own separate tubular shafts, similar to the thumb and index finger configuration of a glove. Again, for the respective reasons described above, these inventions do not present a solution to the present problem. A problem particular to these types of combination gloves and mittens is that the fabric for the featured prior art is not flexible, so a runner who is running outdoors for exercise is not able to maintain various, natural running hand positions without feeling a rigid stiffness from the material of the hand covering. In addition, the runner in this scenario continues to experience the drawbacks commonly experienced with other types of hand coverings where the wearer's index finger and thumb are each contained in separate tubular shafts, and the last three fingers are contained in a balloon styled enclosure.

Oftentimes, a runner exercising in non-ideal conditions will even utilize a long-sleeved shirt and pull the sleeves over his or her hands and fingers in order to provide a protected and more enclosed environment which conforms to the natural configuration of the enclosed hand during exercise.

Outdoor running for exercise is a part of life for many people. Despite the existence of many types of hand coverings to facilitate the function of the hand during outdoor running for exercise, the wearers in general continue to experience discomfort due to surrounding inclement atmospheric, environmental conditions. Moreover the existing hand coverings fail to sufficiently promote the use of the wearer's body heat to maintain a warm environment for the wearer's hand, fingers, fingertips, and thumb while running outdoors for exercise. In addition to the physical impact on the wearer's hands from the outdoor inclement conditions, a wearer also suffers from the impediments of using existing gloves or mittens having stiff or rigid materials not suited to being tactile, flexible, tangible, or not being able to maintain various, natural running hand positions while engaged in running outdoors for exercise.

Accordingly, there is a need for a new and improved dual-use hand covering that protects the hand of a wearer from the atmospheric conditions in the surrounding environment, and that provides better and more advantageous overall results in terms of extending the length of time a user is able to comfortably participate in running for exercise outdoors in less than ideal atmospheric conditions. It is a general object of the present invention to provide such an improved hand covering.

SUMMARY OF THE INVENTION

Recognizing the need for the development of new and improved products and methods for protecting the hand of a wearer from outdoor atmospheric conditions of one who is running for exercise, the present invention is generally directed to the needs set forth above and overcoming the problems with and disadvantages exhibited by prior hand coverings, gloves, and mittens.

The present invention relates to a dual-use hand covering adapted for use by a wearer who is running for exercise, said dual-use hand covering comprising: (a) a clingable sleeve having inner and outer surfaces and having proximal and distal ends and an opening at each end, the opening at the proximal end having a configuration adapted to receive the hand of a wearer, the opening at the distal end having a configuration adapted to allow only the fingertips of the wearer to extend through the opening, and the clingable sleeve enclosing together the four fingers and thumb of a wearer such that the clingable sleeve stays in close proximity to the enclosed hand, (b) a clingable cap having inner and outer surfaces, and a boundary edge that provides an opening to the inner surface, and wherein a portion of the clingable cap boundary edge is attached to the clingable sleeve proximate the distal end and the clingable cap having a first and second position and wherein in the first position the clingable cap encloses the distal end of the clingable sleeve and any fingertips the wearer and in the second position the cap is folded backwards so as to lie proximate a portion of the outer surface of the clingable sleeve and thereby expose the fingertips of the wearer to the surrounding atmospheric conditions, and (c) wherein the clingable sleeve and clingable cap are fabricated from materials providing flexibility and tactile qualities while also protecting the hand of the wearer from the atmospheric conditions in the surrounding environment, and the material of the clingable sleeve provides the clingable sleeve with a desired elastic property so that the material can expand to allow the hand to enter the clingable sleeve and then hold the material in close proximity to the enclosed hand and the material of the clingable cap has a desired elastic property so that the material of said clingable cap is held in close proximity to the enclosed hand.

In other possible embodiments of the present invention: (d) the clingable sleeve is configured to have a substantially tubular shape, (e) the clingable sleeve and clingable cap are constructed from a knitted fabric, (f) the knitted fabric is fabricated from a water repellant material, (g) the knitted fabric is fabricated by employing a knitting technique that provides said clingable sleeve and clingable cap with the desired elastic property.

In addition, the present invention can take the form of a method of forming a dual-use hand covering adapted for use by a wearer who is running for exercise, the method comprising: (a) providing a clingable sleeve having inner and outer surfaces and having proximal and distal ends and an opening at each end, the opening at the proximal end having a configuration adapted to receive the hand of a wearer, the opening at the distal end having a configuration adapted to allow only the tips of the fingers of the wearer to extend through the opening, the clingable sleeve enclosing together the four fingers and thumb of a wearer such that the clingable sleeve stays in close proximity to the enclosed hand, (b) providing a clingable cap having inner and outer surfaces, and a boundary edge that provides an opening to the inner surface, and wherein a portion of the clingable cap boundary edge is attached to the clingable sleeve proximate the distal end and the clingable cap having a configuration adapted to allow the clingable cap to assume a first and second position and wherein in the first position the clingable cap encloses the distal end of the clingable sleeve and any fingertips of the hand of the wearer and in the second position the clingable cap is folded backwards so as to lay proximate a portion of the outer surface of the clingable sleeve and thereby expose the fingertips of the wearer to the surrounding atmospheric conditions, and (c) wherein the clingable sleeve and clingable cap are fabricated from materials providing flexibility and tactile qualities while also protecting the hand of the wearer from the atmospheric conditions in the surrounding environment, and the material of the clingable sleeve provides the sleeve with a desired elastic property to allow the hand to enter the clingable sleeve and then hold the material in close proximity to the enclosed hand and the material of the clingable cap provides the clingable cap with a desired elastic property so that the material of the clingable cap is held in close proximity to the enclosed hand.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
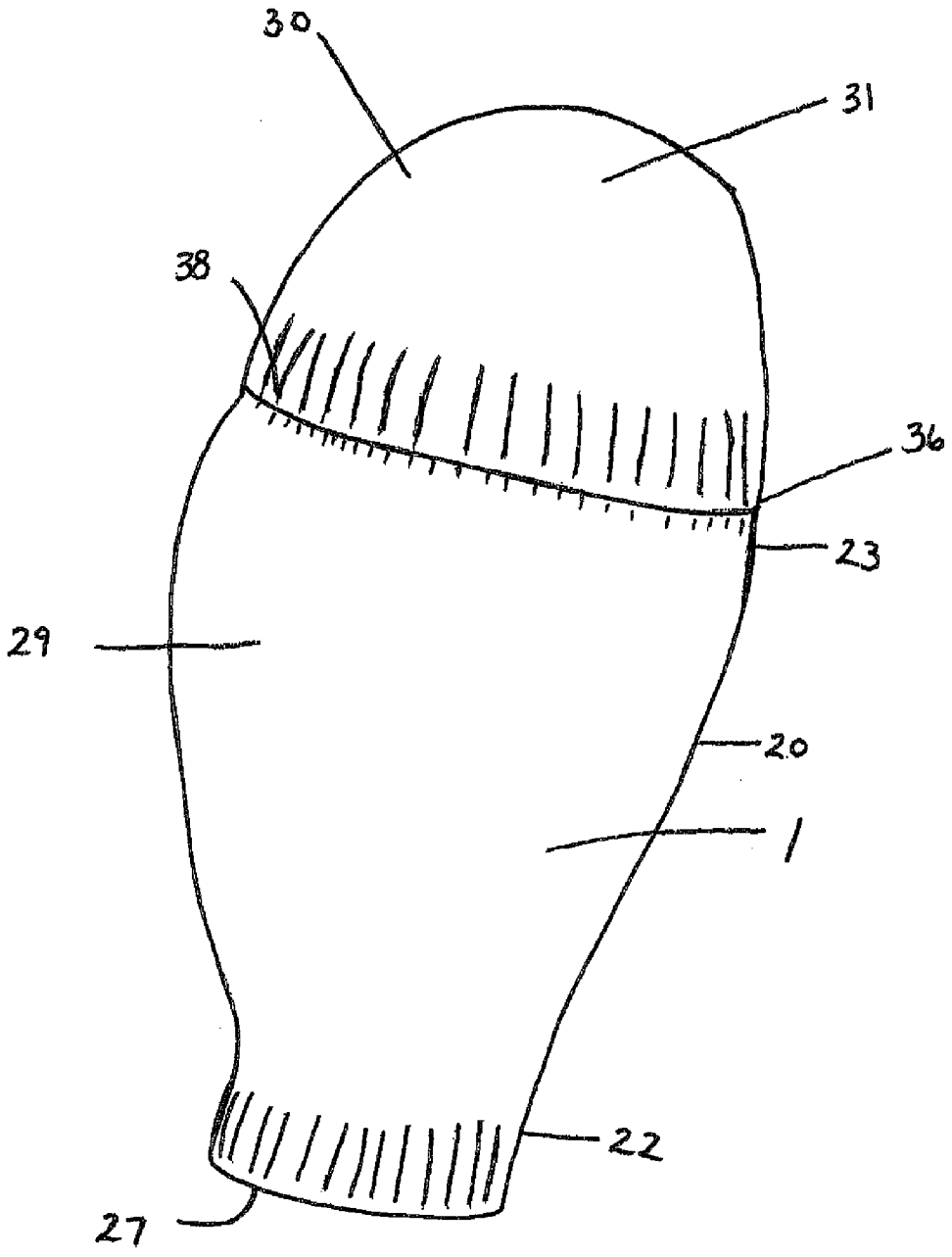
FIG. 1 is a perspective, elevational view that illustrates a preferred embodiment of the present invention, the dual-use hand covering shown in the first, closed position.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. For lexicon purposes, the terminology "hand covering", "mitten", "mitt", and "glove" are used interchangeably.

Referring to FIGS. 1 through 4, there is illustrated a preferred embodiment of the present invention 1 in the form of a dual-use hand covering 1 shown in use on the hand 10 of one who is wearing the covering for use while running for exercise outdoors. The dual-use hand covering comprises a clingable sleeve 20 and clingable cap 30 for protecting the hand 10 of a wearer. The clingable sleeve 20 is substantially tubular in shape and is elongated to fit comfortably on the wearer's wrist and hand. To use the invention 1, the wearer will insert the hand 10 into the clingable sleeve 20 through the bottom opening 27 of the proximal end 22 of the sleeve 20. The wearer will then extend the hand 10 through the clingable sleeve 20 and extend a portion of the wearer's fingers 12 and fingertips 14 out through the distal end 23 of the clingable sleeve 20 through the distal opening 26 until the hand 10 is comfortably placed and positioned within the dual-use hand covering 1.

Figure 2:
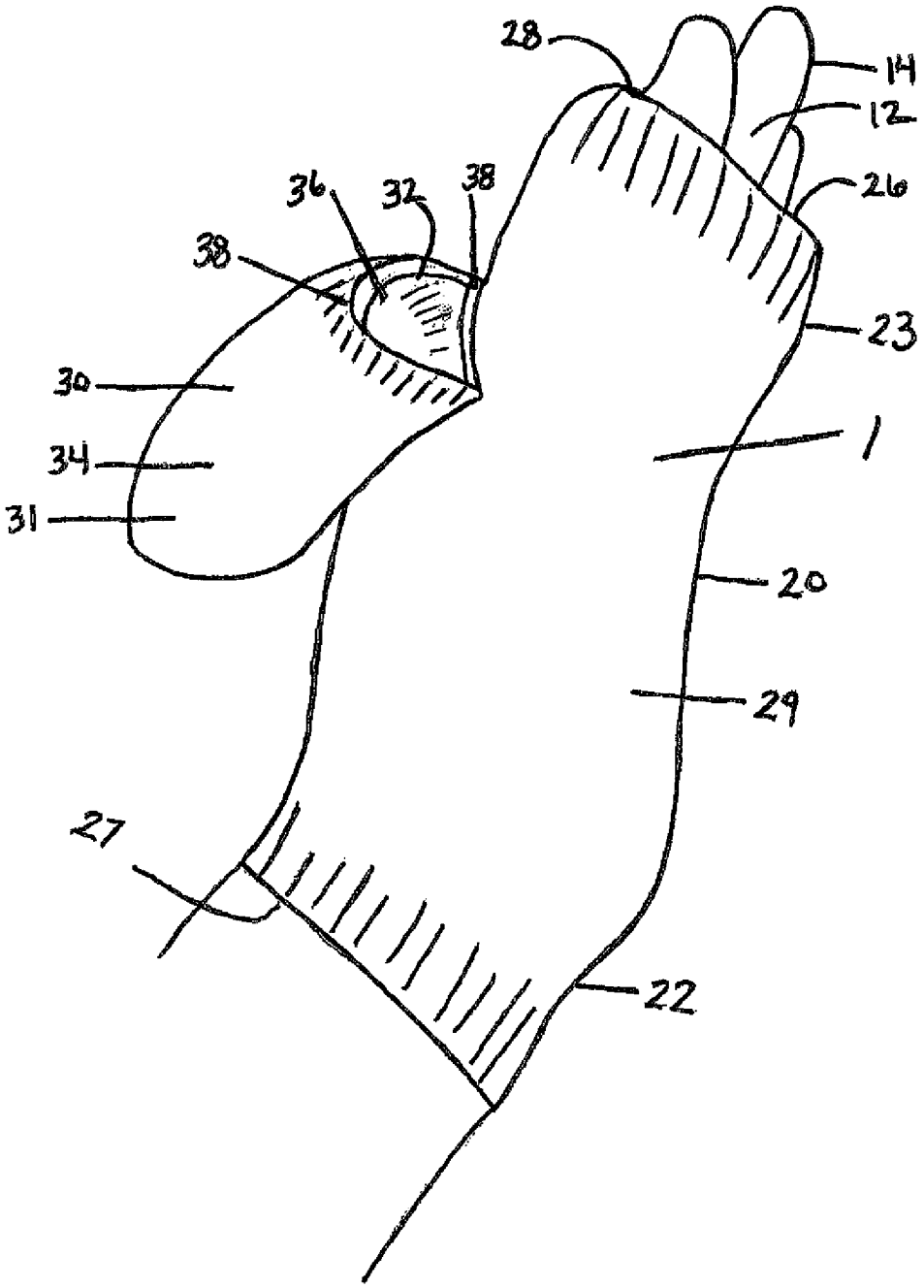
FIG. 2 is a perspective, elevational view that illustrates a preferred embodiment of the present invention, the dual-use hand covering shown in the second, open position.

The wearer may then choose to position the dual-use hand covering in the first, closed position or in the second, open position depending on the atmospheric conditions and influence on the wearer's hand 10. FIGS. 1 and 2 show the dual-use hand covering in use by the wearer in both the first, closed position and second, open position.

Figure 5:
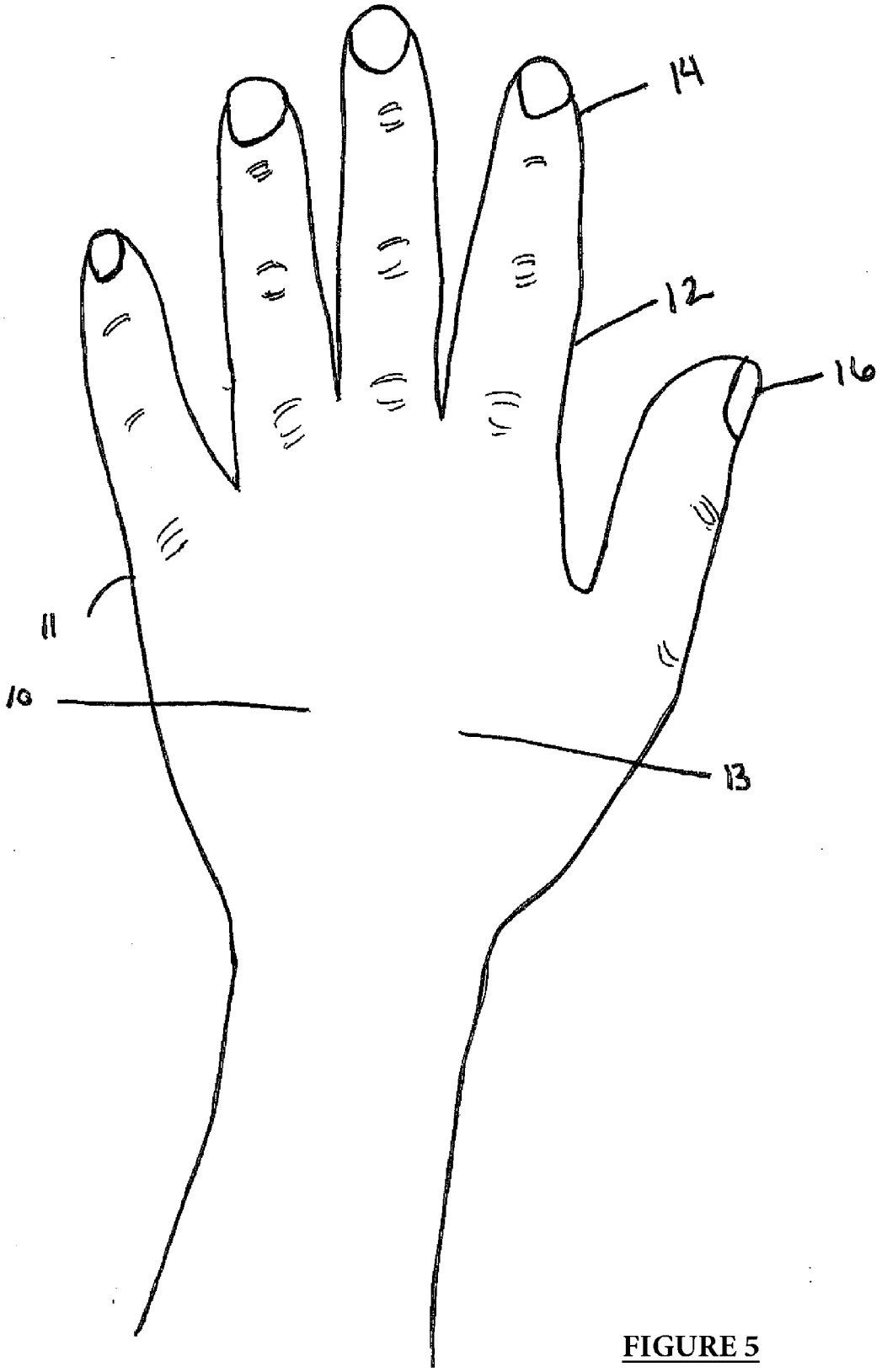
FIG. 5 is a perspective, elevational view of a hand of a wearer.

FIG. 5 shows the hand 10 of the intended user. The hand 10 includes a thumb 16, fingers 12, and fingertips 14.

Various hand coverings exist that differ in style, material, and functionality. These existing hand coverings, however, permit the residual impact from non-ideal atmospheric conditions to still be felt on the wearer's hand and therefore, these hand coverings fail exhibit the tactile qualities, warmth, and comfort needed in connection in order for the wearer to have the proper functioning capabilities of the hand, muscles, and fingers. Instead, the wearer experiences pain, discomfort, numbness, tingling and a reduced temperature overall. Thus, the wearer either will be prevented from running for exercise outdoors entirely, or the length of time spent outdoors will be lessened, in addition to the negative overall impact on a wearer's performance.

The present invention 1 is designed to minimize the effects of non-ideal atmospheric conditions and inclement weather experienced on the wearer's hand 10 of one who is running outdoors for exercise. In using tis invention, the wearer may continue to run outdoors with a certain level of comfort despite the conditions of the surrounding environment. Thus, permitting the wearer to continue to engage in outdoor exercise and other activities despite inclement weather conditions. Therefore, use of the dual-use hand covering is particularly suited for the wearer who desires to continue to run for exercise outdoors in non-ideal atmospheric conditions.

The present invention 1 is seen to comprise parts or elements that include a clingable sleeve 20 and clingable cap 30, wherein the clingable sleeve 20 and clingable cap 30 are fabricated from materials selected so as to provide a dual-use hand covering with flexibility, clingable, and tactile qualities along with a desired elastic property so that the covering is held in close proximity to a wearer's enclosed hand 10, while also protecting the hand 10 of the wearer from inclement atmospheric conditions in the surrounding environment. See FIG. 1. The hand covering 1 encapsulates the hand 10, fingers 12, fingertips 14, and the thumb 16 of the wearer and the elastic property of the hand covering 1 provides a comfortable, tactile and tangible environment for the hand and minimizes the space between the hand covering 1 and the wearer's hand 10, fingers 12, fingertips 14, and thumb 16 to promote and use the wearer's body heat to maintain a warm environment for the wearer's hand 10, fingers 12, fingertips 14, and thumb 16 during outdoor running for exercise.

FIGS. 1 and 2 show that the clingable sleeve 20 comprises a proximal end 22 and a distal end 23, an inner surface 28 and outer surface 29, and a top opening 26 and bottom opening 27. The clingable sleeve 20 is configured to receive the hand 10 of a wearer through the bottom opening 27 of the proximal end 22 of the clingable sleeve 20. The clingable sleeve 20 allows a portion of the hand 10 to extend through the sleeve 20 and permit a portion of the wearer's fingers 12 and fingertips 14 to extend beyond the top opening 26 of the distal end 23 of the clingable sleeve 20. The clingable sleeve 20 also has a configuration adapted to enclose together the four fingers 12 and thumb 16 of the wearer such that the clingable sleeve 20 stays in close proximity to the enclosed hand 10 of the wearer. See FIGS. 1 and 2.

Referring to FIGS. 1 and 2, the clingable cap 30 comprises an inner surface 32, outer surface 34, and a boundary edge 38 that provides for an opening 36 to the inner surface 32 of the clingable cap 30. The clingable cap 30 is attached to the clingable sleeve 20 by way of a portion of its boundary edge 38 proximate to the distal end 23 of the clingable sleeve 20. The clingable cap 30 is configured to receive and enclose a portion of the wearer's fingers 12 and the wearer's fingertips 14 through the cap opening 36 at the distal end 23 of the clingable sleeve 20. The clingable cap 30 has functionality and is adapted to be situated in a first, closed position and a second, open position to enclose or expose a portion of the fingers 12 and fingertips 14 of the wearer.

Figure 4:
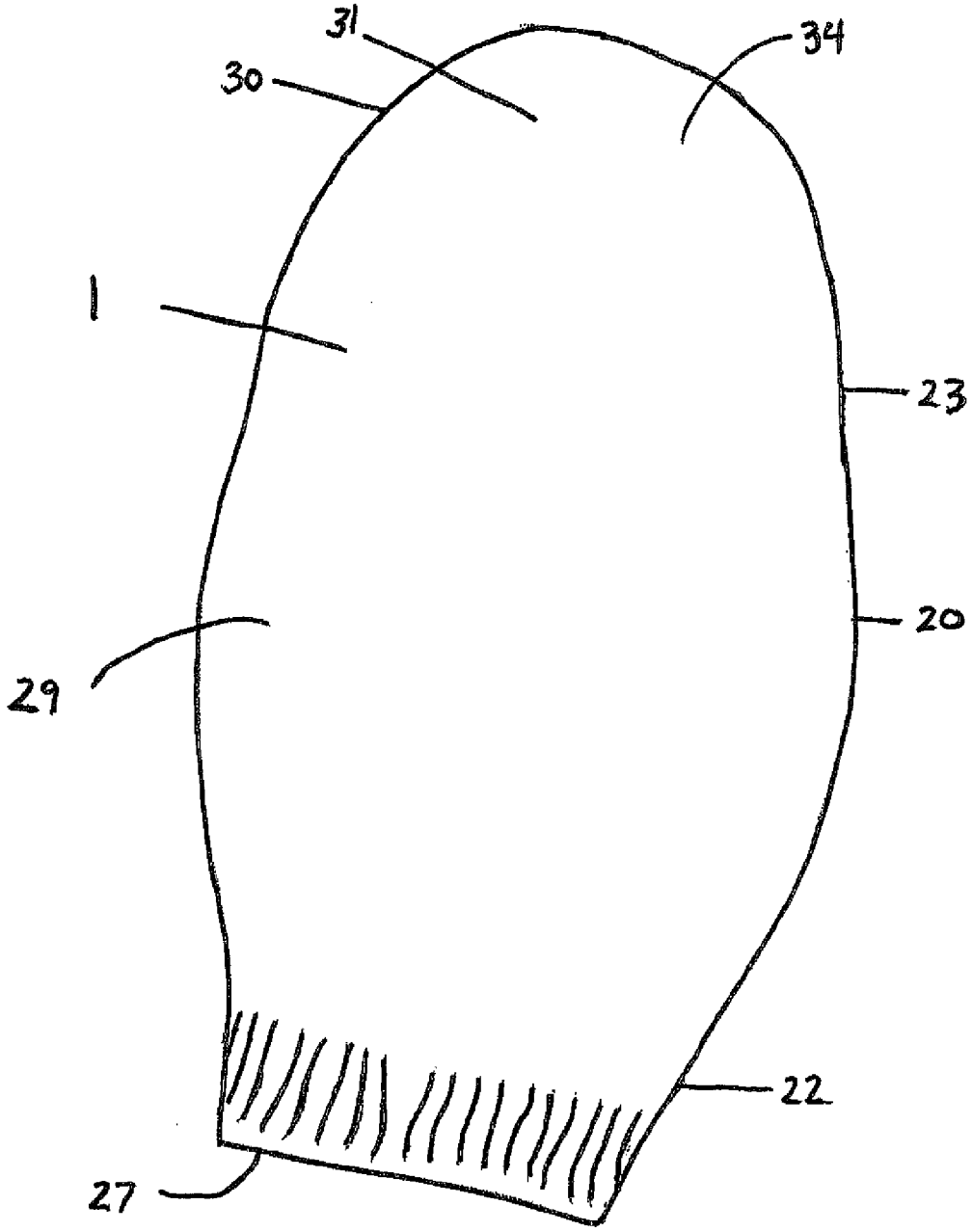
FIG. 4 is a perspective, elevational back view that illustrates a preferred embodiment of the present invention, the dual-use hand covering shown in the first, closed position.

FIGS. 1 and 4 show the clingable cap 30 in the first, closed position such that the cap 30 encapsulates the tips 14 of the wearer's fingers 12 together with the clingable sleeve 20 in order to enclose the wearer's hand 10 in its entirety and protect the wearer's hand 10 from the atmospheric elements. To wear the clingable cap 30 in the first, closed position, the wearer moves the cap opening 36 forward over the wearer's exposed fingers 12 and fingertips 14 protruding from the distal end 23 of the open sleeve 26 such that the clingable cap 30 encapsulates the entire hand 10 within the hand covering 1. In this position, the portion of the cap boundary edge 38 that forms the cap opening 36 and encapsulates the fingertips 14 on the palm side of the wearer's hand sits proximate to the distal end 23 of the clingable sleeve 20. The enclosure formed by the clingable cap 30 and clingable sleeve 20 configuration minimizes the space that exists between the hand covering material and the surface of the wearer's hand and therefore provides an environment that utilizes the wearer's body heat to maintain a comfortable enclosed space for the wearer's hand 10. In addition, because the hand 10 of the wearer is enclosed within the dual-use, clingable hand covering 1 having a protective clingable sleeve 20 and clingable cap 30, the wearer's hand 10 is not exposed to inclement atmospheric conditions, which typically cause discomfort, numbness, decrease in body temperature, tingling and pain.

Figure 3:
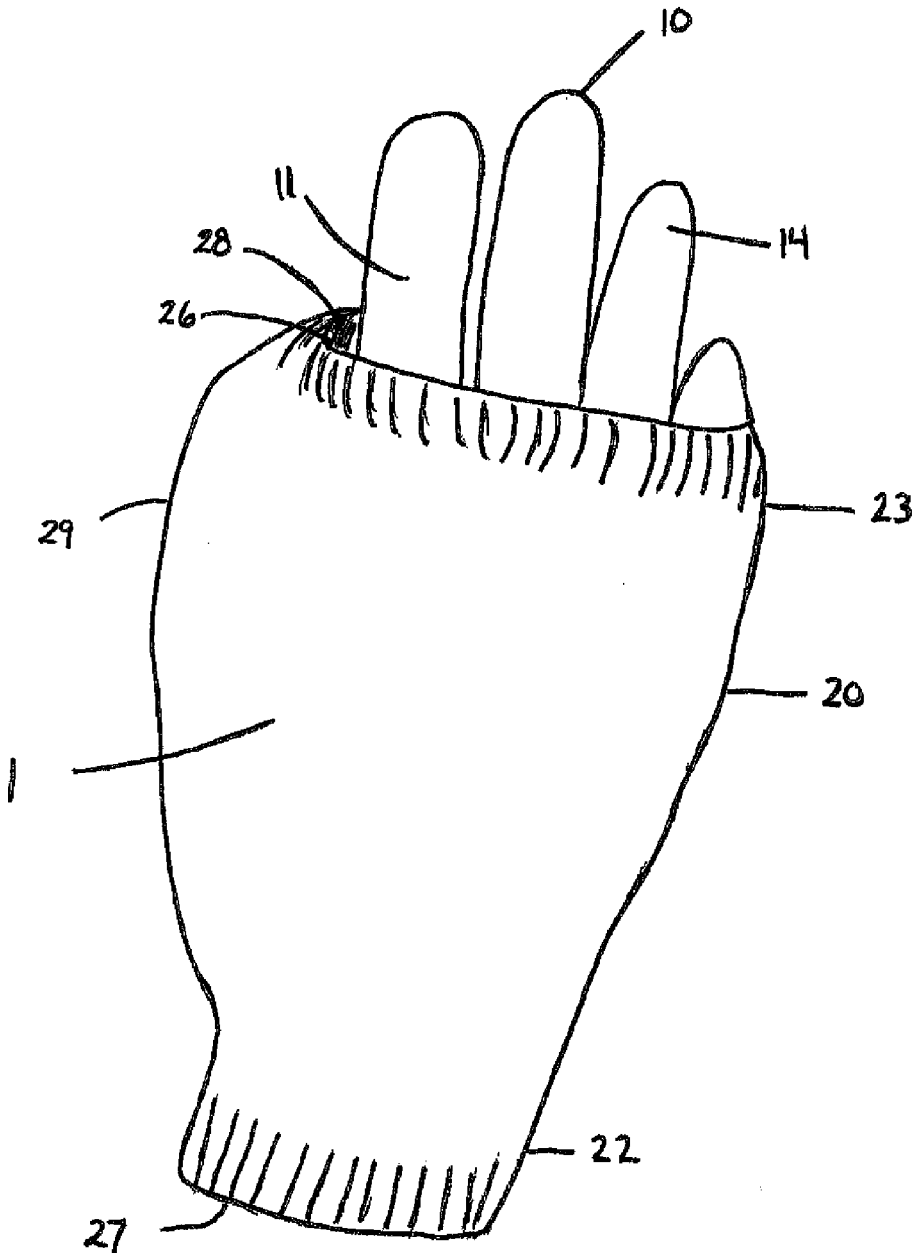
FIG. 3 is a perspective, elevational front view that illustrates a preferred embodiment of the present invention, the dual-use hand covering shown in the second, open position.

FIGS. 2 and 3 show the clingable cap 30 in the second, open position such that the wearer's fingertips 14 and a portion of the fingers 12 protruding from the distal end 23 of the open clingable sleeve 20 are exposed to the atmospheric elements. The wearer removes the opening 36 of the clingable cap 30 from the fingertips 14 and folds the clingable cap 30 over backwards and away from the fingertips 14 so that the clingable cap 30 lays proximate to the outer surface 29 of the clingable sleeve 20 on the backside of the hand 10. As such, the wearer's fingertips 14 and a portion of the wearer's fingers 12 are left exposed to the surrounding atmospheric conditions. See FIGS. 1 and 2. In one possible embodiment, the wearer may secure the top portion 31 of the clingable cap 30 to the clingable sleeve 20 on the backside of the hand while in the second, open position by utilizing attachment means such that the top portion 31 of the clingable cap 30 continues to stay in the open position while in use. For example, attachment means may include a releasable configuration in combination with buttons, fasteners, zippers, snaps, hooks and loops, or by other means.

In the second, open position of the dual-use hand covering 1, the wearer also may then use his or her fingers 12 and fingertips 14 to engage in certain activities and achieve a certain level of dexterity because a portion of the fingers 12 and fingertips 14 of the wearer are exposed. The extent of the use of the wearer's fingers 12 will be determined by how the wearer positions the sleeve 20 of the hand covering 1, as the sleeve 20 may be adjusted further down the wearer's hand 10 in order to accommodate use of the fingers 12.

The clingable sleeve 20, which can be of any desired shape or form, is preferred in a substantially tubular shape and the clingable cap 30 is preferred in a substantially convex cavity shape. It should be understood that the clingable sleeve 20 and clingable cap 30 could be otherwise configured and sized and formed for contacting more or less of the hand 10, fingers 12 and fingertips 14 of the wearer. While the clingable sleeve 20 is elongated to fit comfortably on the wearer's wrist and hand, it should be understood that the elongated clingable sleeve 20 could also extend further down the wearer's forearm.

The clingable cap 30 is attached to the clingable sleeve 20 by way of a portion of its boundary edge 38 proximate to the distal end 23 of the clingable sleeve 20. In one embodiment, a portion of the boundary edge 38 of the clingable cap 30 is permanently sewn proximate to the distal end 23 of the clingable sleeve 20. It also should be understood that the attachment could be provided with any suitable any attachment, connecting, or coupling means without departing from the scope of the present invention. For example, attachment means between the clingable cap 30 and clingable sleeve 20 may be of the permanent type or releasable type without departing from the scope of the invention. Accordingly, the clingable cap 30 can easily be permanently sewn to adjoin the clingable cap 30 to the clingable sleeve 20 or be configured as a continuous extension of the clingable sleeve 20. In addition, the clingable cap 30 could be attached in in a releasable configuration in combination with buttons, fasteners, zippers, snaps, hooks and loops, or by other means. In addition, one embodiment features the clingable cap 30 in a tapered configuration proximate a portion of the cap boundary edge 38 and opening 36 and to secure the clingable cap 30 to the hand 10 of the wearer in order to achieve clingable characteristics. In another possible embodiment, elastic material, or similar means, may be applied in all or a portion of the cap opening 36 in order to secure the clingable cap 30 to the hand 10 of the wearer.

In addition, often times, a wearer holds and engages his or her hand 10 in a natural running position when running for exercise. This hand position is often in a comfortable, enclosed position suited to that particular individual. The materials used to fabricate the dual-use hand covering 1, clingable cap 30, and clingable sleeve 20, are selected so as to be clingable to the wearer's hand 10, such that the material has a desired elastic property and has flexible, tactile, and tangible qualities so that the material is held in close proximity to the wearer's enclosed hand 10 in the natural running position. The clingable material serves to minimize the space that exists between the material of the hand covering 1 and the surface of the wearer's hand 10. The combination of the hand covering configuration and the clingable material encapsulate the wearer's hand 10, fingers 12, fingertips 14, and thumb 16 together to promote use of the wearer's body heat to maintain a warm environment for the wearer's hand 10, fingers 12, fingertips 14, and thumb 16. In addition, the material of the clingable sleeve 20 is further selected with a desired elastic property so that the material can expand to allow the hand 10 to enter the sleeve 20 and be held in close proximity with the wearer's enclosed hand 10. See FIG. 1.

A knitted material is probably the most common material used in fabricating many types of hand coverings. As for the present invention 1, there are many suitable materials from which the dual-use hand covering 1 can be fabricated and all are considered to come within the scope of the present invention. A major consideration in the selection of such a material is the requirement that it be sufficiently clingable and effectively protect the wearer's hand 10 from unpleasant atmospheric weather conditions while keeping the wearer's hand 10 comfortable and allowing the wearer to maintain a certain level of dexterity in the wearer's hand 10 and fingers 12 if needed. In addition, the selected material is tactile and tangible in order to remain in close proximity the wearer's hand 10. The selected material is suitable to maintain a configuration that is clingable such that it is in close proximity with the wearer's hand 10 and minimizes space between the material and the hand. Thus, many embodiments of the present invention 1 feature the clingable sleeve 20 and clingable cap 30 constructed from a knitted fabric. After some experimentation, however, a knitted material was selected from which to fabricate most preferred embodiments of the present invention 1. Moreover, in some embodiments of the present invention 1, the knitted material is fabricated by employing a knitting technique that provides the clingable sleeve 20 and clingable cap 30 with a desired elastic property that exhibits the qualities described above.

For example, suitable materials for the hand covering 1, include materials such as cloth, wool, cotton, polyester, fleece, polypropylene, expanded-polytenafluomethylene, nylon, neoprene, fabric, leather, natural or synthetic fiber, para-aramid synthetic fiber. It should be appreciated by those skilled in the art that any similar material, or combination thereof, may also be used to fabricate the invention. Likewise, another embodiment of the invention features a knitted fabric constructed from a water repellant material. A knitted material was also found to be the most cost effective for the current application. The fabrication materials yield a hand covering that is easily and continuously used and that will provide years of effective use.

In addition, in at least some embodiments of the invention, the clingable sleeve 20 and clingable cap 30 may have a different material or texture. It should be understood that other types of materials or textures could be used without departing from the scope of the present invention, along with slight variations in shape. For example, one embodiment features the clingable sleeve 20 in a tapered configuration.

In another preferred embodiment, the dual-use hand covering 1 was lined on the sleeve inner surface 28 and cap inner surface 32 with a suitable insulation material to maintain a warm enclosed environment for the wearer's hand 10. In another preferred embodiment, the inside lining material selected was a felt material. It should be noted that any suitable material may be used to line the inner surfaces, such as cloth, felt, wool, cotton, polyester, fleece, polypropylene, Goretex®, nylon, neoprene, fabric, leather, natural or synthetic fiber, para-aramid synthetic fiber, or the like material.

Likewise, in another possible embodiment, the dual-use hand covering 1 features a pocket on the inside of the hand covering 1. The pocket allows the wearer to place a hand warmer or other small items within the pocket. In one embodiment, for example, the pocket was featured on the inside 28 of the clingable sleeve 20 such that pocket lays proximate to the palm of the wearer's hand 10. Other embodiments feature alternate locations for the placement of the pocket.

In yet another possible embodiment, the dual-use hand covering 1 is fabricated from material configured in a knitted pattern, having a ribbed texture or similar material configuration and having a desired elastic property in order to secure the hand covering 1 to the wearer's hand 10 without the use of alternative fixture means such that the material is held in close proximity to the wearer's enclosed hand 10 when held in a natural, running position. Another embodiment features the material of the dual-use hand covering 1 configured in a tapered fashion in proximity to the sleeve openings 26, 27, and cap opening and 36 to hold such material in close proximity to the enclosed hand 10 of the wearer. The clingable cap 30 may be closed in the first position to encapsulate the hand and further secured on the palm side of the wearer's hand 10 by means, for example, of elastic or ribbed textured material. Thus, the material of the clingable cap 30 is further secured and kept in close proximity to the clingable sleeve 20 on the inside of the wearer's hand 10. Other examples of means to further secure the clingable cap 30 with the clingable sleeve 20, although not required, include the use of buttons, fasteners, zippers, snaps, hooks and loops, or other means.

In one preferred embodiment, the clingable sleeve 20 of the dual-use hand covering 1 is substantially tubular in shape. The dimensions of the clingable sleeve 20 and clingable cap 30 will vary according to hand size. In one embodiment, the dual-use hand covering 1 was fabricated having dimensions of: a clingable cap 30 length of 2.5 inches and a width of 3.5 inches at the widest point; and a clingable sleeve 20 length of 7.5 inches and a width that begins at 4 inches at the widest part substantially across the palm of the hand and tapers to 3.5 inches. Therefore, the total dimensions of the dual-use hand covering 1 with the clingable sleeve 20 and clingable cap 30 in the first, closed position are as follows: 9 inches in length, and the variable width that begins at 4 inches at the widest part across the palm of the hand and tapers to 3.5 inches proximate to the fingertips. These dimensions represent one embodiment of the invention. The dimensions will vary according hand size.

It should be understood, however, that the hand covering 1, clingable sleeve 20 and clingable cap 30 can be of many shapes, sizes, and diameters without departing from the scope of the present invention. Moreover, another embodiment of the present invention features dimensions that are dependent on the size of the hand 10 of the wearer. Thus, it also should be understood depending on the dimensions of the hand covering selected and because the size of the wearer's hand will vary, that the positioning of the clingable sleeve 20 and clingable cap 30 on the wearer's hand will vary from wearer to wearer. In addition, more or less fingertips may be exposed in the second, open position depending on the size of the wearer's hand, the positioning of the sleeve on the wearer's hand, and the size of the clingable dual-use hand covering selected by the wearer.

Experimentation was conducted to determine the optimal size and positioning of the clingable sleeve 20 and clingable cap 30 for an adequate surface area on which the hand 10 of the wearer would be covered in order to relieve the impact of the external atmospheric and environmental conditions on the hand 10.

Advantages of the present invention include the clingable cap 30 that is designed to minimize less than ideal conditions experienced by a wearer in inclement atmospheric weather conditions while allowing the wearer to perform activities requiring a selected level of dexterity of the hand 10, portion of the fingers 12 and fingertips 14 without substantially interrupting the activity being performed. With the dual-use hand covering clingable cap 30 in the open, second position, the wearer is able to conduct functions that require the use of his or her thumb 16, fingers 12 and fingertips 14. In the closed, first position, the dual-use hand covering cap 30 encapsulates and encloses the hand 10, thumb 16, fingers 12 and fingertips 14, thereby providing an environment to shield or minimize external inclement weather conditions that may cause the hand 10 of the wearer to experience a decrease in body temperature, loss of feeling or to experience numbness, tingling, discomfort or pain.

The proposed dual-use hand covering also allows the wearer to maintain a warm and comfortable temperature for the wearer's hand 10. The sizing may be adjusted to a variety of lengths and widths in order to account for the sizing of the hand 10 of the wearer.

Furthermore, the proposed dual-use hand covering is designed to be easily used and manufactured using conventional forms of manufacturing in conventional materials so as to provide a dual-use hand covering 1 that will be economically feasible, long lasting, and relatively trouble-free in use.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is illustratively set forth in the following representative claims to the present invention.

I claim:

1. A dual-use, hand covering adapted for use by a wearer who is running for exercise, said dual-use, hand covering comprising:

a sleeve having inner and outer surfaces and having proximal and distal ends and a sleeve opening at each said ends, said sleeve opening at said proximal end having a proximal enclosed area that is designed to receive the hand of a wearer, said sleeve opening at said distal end having a distal enclosed area that is designed to allow only the distal phalange of each of the four fingers of said wearer to fully extend through said sleeve opening at said distal end, said sleeve having a surface area that is designed to enclose together the four fingers and the entire thumb of a wearer except for the distal phalange of each of the four fingers of said wearer, and said sleeve being fabricated from a material selected so as to enable said inner surface of said sleeve to stay, when worn, at all times in close proximity to the four fingers and the entire thumb of a wearer except for the distal phalange of each of the four fingers of said wearer, when worn a cap having inner and outer surfaces, and a boundary edge that provides a cap opening to said inner surface, and wherein a portion of said cap boundary edge is attached to said outer surface of said sleeve proximate said distal end of said sleeve, and said inner surface of said cap having a surface area that is designed to allow said cap to assume a first and a second position and wherein in said first position said cap encloses said distal end of said sleeve and only the distal phalange of each of the four fingers of said wearer that extend through said sleeve opening in said sleeve distal end, and in said second position said cap is folded backwards so as to lay proximate to a portion of said outer surface of said sleeve and thereby expose only the distal phalange of each of the four fingers of said wearer to the surrounding atmospheric conditions, and said cap being fabricated from a material selected so as to enable said inner surface of said cap, when in said first position, to stay at all times in close proximity to the enclosed distal end of said sleeve and only the distal phalange of each of the four fingers of said wearer that fully extend through said sleeve opening in said sleeve distal end when worn, and wherein said sleeve material further selected so as to enable said sleeve to expand to allow the hand of said wearer to enter said sleeve.

2. The dual-use, hand covering as recited in claim 1, wherein:

said sleeve having a substantially tubular shape in which the widest portion of said sleeve occurs proximate a palm area of the hand of a wearer and the sleeve width then decreases in width towards the distal end of said sleeve.

3. The dual-use, hand covering as recited in claim 1, wherein:

said sleeve and cap are fabricated by employing a knitting technique that enables said inner surface of said cap, when in said first position, to stay at all times in close proximity to the enclosed distal end of said sleeve and the distal phalange of each of the four fingers of the hand of said wearer that fully extend through said opening in said sleeve distal end.

4. The dual-use, hand covering as recited in claim 2, wherein:

said sleeve and cap are fabricated by employing a knitting technique that enables said inner surface of said cap, when in said first position, to stay at all times in close proximity to the enclosed distal end of said sleeve and the distal phalange of each of the four fingers of the hand of said wearer that fully extend through said opening in said sleeve distal end.

5. The dual-use, hand covering as recited in claim 1, wherein:

said sleeve and cap material further selected to be a water repellant material.

6. The dual-use, hand covering as recited in claim 2, wherein:

said sleeve and cap material further selected to be a water repellant material.

7. The dual-use, hand covering as recited in claim 3, wherein:

said sleeve and cap material further selected to be a water repellant material.

8. The dual-use, hand covering as recited in claim 4, wherein:

said sleeve and cap material further selected to be a water repellant material.

* * * * *